US007138954B2

(12) United States Patent
Schillmeier et al.

(10) Patent No.: US 7,138,954 B2
(45) Date of Patent: Nov. 21, 2006

(54) ANTENNA ASSEMBLY COMPRISING A SURFACE DIPOLE

(75) Inventors: Gerald Schillmeier, Munich (DE); Gerhard Stadler, Raubling (DE); Ralf Exler, Kolbermoor (DE); Andreas Wild, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/528,105

(22) PCT Filed: Sep. 11, 2003

(86) PCT No.: PCT/EP03/10136

§ 371 (c)(1),
(2), (4) Date: Mar. 16, 2005

(87) PCT Pub. No.: WO2004/027929

PCT Pub. Date: Apr. 1, 2004

(65) Prior Publication Data

US 2006/0164316 A1 Jul. 27, 2006

(30) Foreign Application Priority Data

Sep. 16, 2002 (DE) ..... 102 42 935

(51) Int. Cl.
*H01Q 9/28* (2006.01)

(52) U.S. Cl. ..... 343/795; 343/850

(58) Field of Classification Search ..... 343/700 MS, 343/795, 850

See application file for complete search history.

(56) References Cited

U.S. PATENT DOCUMENTS 4,381,566 A 4/1983 Kane ..... 455/193
5,229,777 A * 7/1993 Doyle ..... 343/700 MS
5,396,658 A * 3/1995 Hwu et al. ..... 455/327
6,317,089 B1 * 11/2001 Wilson et al. ..... 343/713
6,429,819 B1 * 8/2002 Bishop et al. ..... 343/725

FOREIGN PATENT DOCUMENTS

| | | |
|---|---|---|
| DE | 31 50 958 A1 | 7/1983 |
| DE | 34 05 044 C1 | 8/1985 |
| DE | 35 04 719 A1 | 8/1986 |
| EP | 0 254 373 A1 | 1/1988 |
| EP | 1 195 899 A2 | 4/2002 |
| WO | 02/067379 A1 | 8/2002 |

OTHER PUBLICATIONS

M. J. Salvati, "A Miniature Broadband Antenna", Electronic Design; Penton Publishing, vol. 43, No. 4, Feb. 29, 1995, p. 107, XP000501541.

G. Flachenecker et al., "Aktive Antennen IM Frequencbereich Von 100 KHZ bis MHZ", vol. 24, No. 5, May 1, 1971, pp. 231-236, XP002062352.

International Search Report, Jan. 2004.

* cited by examiner

*Primary Examiner*—Tan Ho
(74) *Attorney, Agent, or Firm*—Nixon & Vanderhye P.C.

(57) ABSTRACT

An improved antenna assembly, wherein: the opposing end regions of the dipole halves are each electrically connected to a respective connection line; the connection lines lead to two amplifiers; the outputs of both amplifiers are connected to the two inputs of a transform, whose output is at least indirectly electrically connected to a connector, a coaxial connector; one or more filters are provided; the filters are positioned between the connection lines and the connector terminal; the filter or filters is/are designed to suppress mobile radio frequency ranges and/or to protect broadcasting signals.

5 Claims, 4 Drawing Sheets

ANTENNA ASSEMBLY COMPRISING A SURFACE DIPOLE

This application is the US national phase of international application PCT/EP2003/010136 filed 11 Sep. 2003 which designated the U.S. and claims priority of DE 102 42 935.9, filed 16 Sep. 2002, the entire contents of each of which are hereby incorporated by reference.

The invention relates to an antenna arrangement having a flat dipole, as claimed in the precharacterizing clause of claim 1.

Dipole antennas are sufficiently well known and can be used to receive widely differing frequencies. The length of the dipole halves in this case depends on the respective frequency range to be transmitted or received.

In this context, in principle, flat dipoles are also known whose dipole halves comprise, for example, two rectangular conductive dipole halves which, for example, may be produced on a substrate, even in the form of a printed circuit board.

Flat dipoles such as these may be used, for example, for DVB-T reception. However, on the one hand they have a Q-factor which is not sufficient for many applications and/or in particular they do not have an adequate bandwidth particularly when they are intended to be designed to be comparatively compact in comparison to the operating wavelength.

Fundamentally, it could be possible to design an antenna arrangement with a flat dipole, by way of example, for the UHF band, that is to say for a frequency range which extends from about 470 MHz to 862 MHz.

If, in contrast, one wished to design a flat antenna for the VHF band, that is to say, by way of example, for a frequency range from 160 MHz to 230 MHz, then antennas such as these would have to be physically enormously large.

An antenna arrangement of this generic type has been disclosed in DE 34 05 044 C1. This comprises a flat dipole whose dipole halves are provided with end areas which run towards one another to a point, where a respective connecting line is connected, which leads to two amplifiers. The outputs of the amplifiers are then interconnected via a transformer in the form of an addition element and are connected to a common connecting point, preferably in the form of a coaxial connection.

In contrast, the object of the present invention is to provide an improved antenna arrangement with a flat dipole, in particular for DVB-T operation. In this case, the antenna according to the invention should be comparatively small and should preferably be operable in two frequency bands, specifically, by way of example, in the UHF band and in the VHF band. However, the antenna should in this case also be suitable for disturbance-free operation.

According to the invention, the object is achieved by the features specified in claim 1. Advantageous refinements of the invention are specified in the dependent claims.

It must be regarded as being quite surprising that the solution according to the invention has for the first time made it possible to design an antenna arrangement with a flat dipole with comparatively small dimensions in order to be capable of use in this case in particular not only for the UHF range but also for the VHF range. Particularly for the last-mentioned range, it is in this case surprising that this can be achieved by means of a comparatively physically small antenna.

The antenna arrangement according to the invention also comprises, as in the case of the prior art, an active antenna with an amplifier arrangement. Each dipole half is in this case provided with a separate connecting line, in each of which an amplifier module is arranged, at the dipole ends which point towards one another (and are located in the center).

However, it was impossible to design an antenna arrangement with a flat dipole which has good reception characteristics for two such distinct frequency bands, for example in the UHF and VHF range and which, while being physically small, can be used in particular for DVB-T operation.

The antenna according to the invention in this case has characteristics which are as good as if it were formed from two separate individual antennas, with one of the individual antennas being optimized, for example, to receive the VHF band and the other individual antenna being optimized to receive the UHF band!

The antenna according to the invention is in this case optimized for minimum noise. This is achieved by the further surprising feature that each dipole half initially has its own associated amplifier stage. The outputs of the amplifier stages are then joined together, with a coplanar line, which leads to a coaxial cable connection, being used in one preferred embodiment here.

The antenna according to the invention is distinguished in that at least one and preferably two or more filter arrangements or filter modules is or are provided, which make it possible to suppress specific frequencies which are a hindrance to optimum operation. Frequency bands such as these which need to be suppressed may, for example, be radio frequency bands or else specific mobile radio frequency bands.

One preferred variant according to the present invention in this case also provides for the connecting lines, that is to say the lines between the end areas of the dipole halves and the respective downstream amplifier, to have a capacitive coupling, that is to say, in other words, a capacitance. Inter alia, this also improves the electromagnetic compatibility (improved EMC protection).

One preferred development of the invention in this case also provides for a high-pass filter also to be provided between the two dipole halves and thus between the two inputs of the two amplifier stages. In this case, the high-pass filter may be electrically connected directly between the outputs of the dipole halves, that is to say still upstream of the capacitances which are preferably provided and are integrated in the connecting lines. However, this high-pass filter can also be connected at a different point, specifically to those sections of the two connecting lines which are located between the two capacitances that are provided in the connecting lines and the downstream amplifiers. In both cases, the capacitances which have been mentioned in the two connecting lines further improve the effect of the high-pass filter.

Finally, it has been found to be advantageous for the two amplifier stages to be joined together on a common output line via a transformer. A 1:1 transformer is preferably used for this purpose, for example a Guanella transformer.

A further advantageous improvement can be achieved by, for example, first of all arranging a low-pass filter (GSM filter), which may then also be followed by a bandstop filter, between the coaxial connection of the antenna arrangement and the two amplifier stages, preferably between the coaxial connection and the transformer that has been mentioned. The low-pass filter that has been mentioned makes it possible to ensure that telephone calls can be made without any problems in the air, that is to say telephone calls can be made using a mobile radio or so-called cellular telephone without the possibility of these frequencies being received by the indoor antenna that has been mentioned and the corresponding signals being able to reach the coaxial connection. The bandstop filter which has been mentioned can preferably be in the range, for example, between 230 MHz and 470 MHz, and is used to cut off this frequency range which is generally kept free and is available for various services. This frequency band range includes control frequencies which can be used freely for electrical appliances, etc.

Despite the flat dipole structure, the antenna according to the invention has a virtually optimum omnidirectional characteristic. It is particularly suitable for indoor operation, especially for DVB-T reception of broadcast radio and television programs.

Further advantages, details and features of the invention will become evident in the following text from the explained exemplary embodiments. In this case, in detail:

Figure 3:
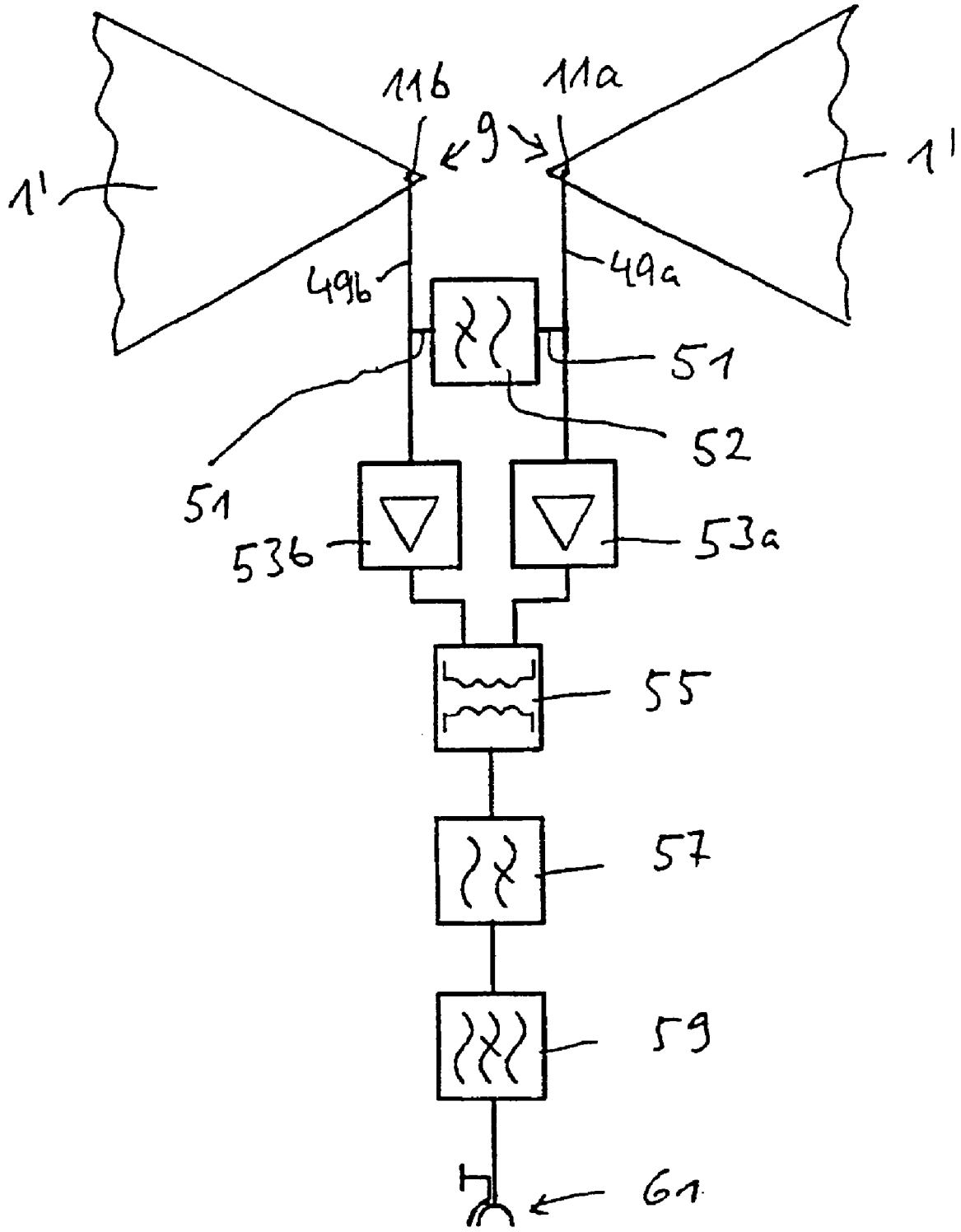
FIG. 3 shows an enlarged plan view of the amplifier arrangement and connecting arrangement, via which the dipole halves are connected to a coaxial connection.
Figure 4:
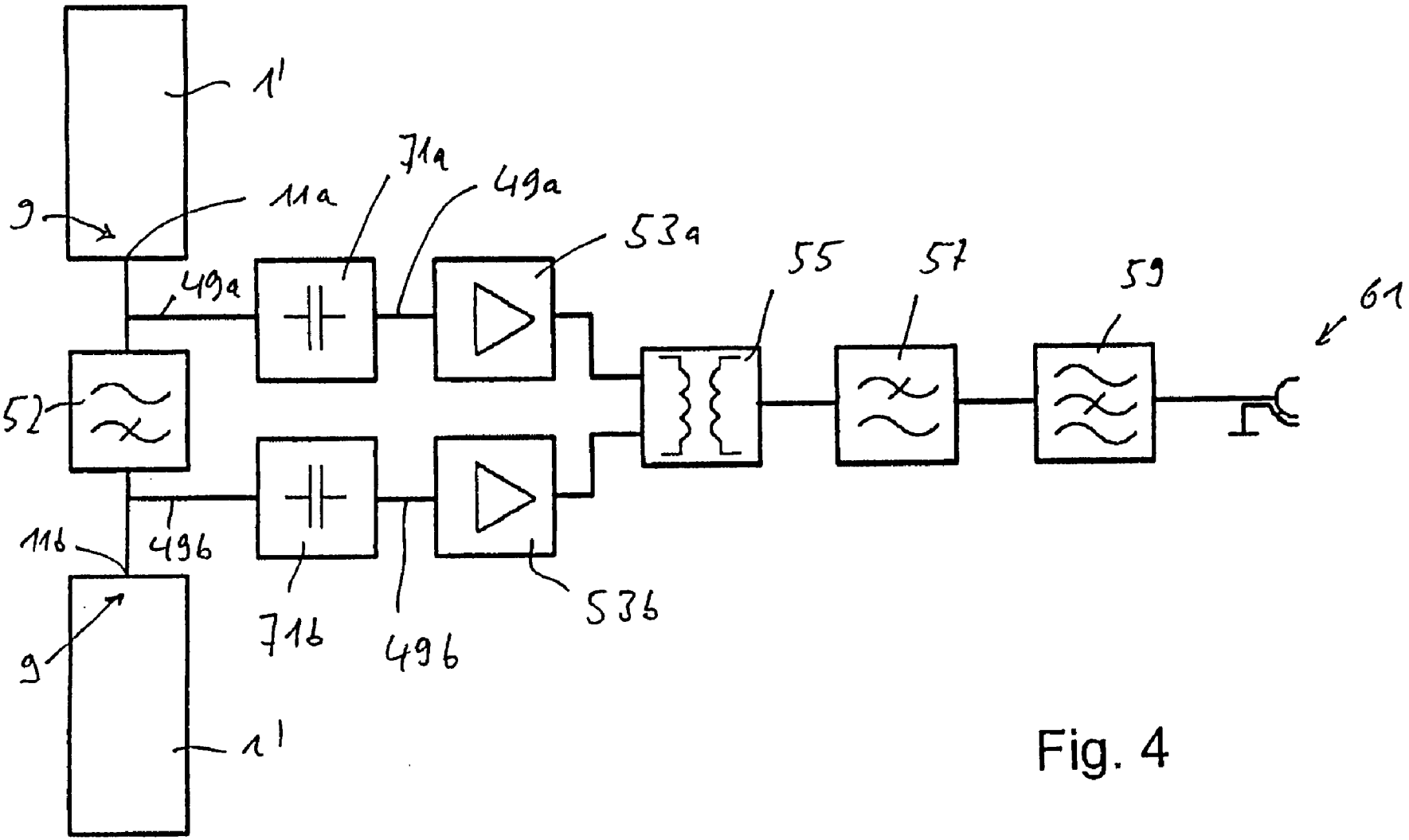
Figure 5:
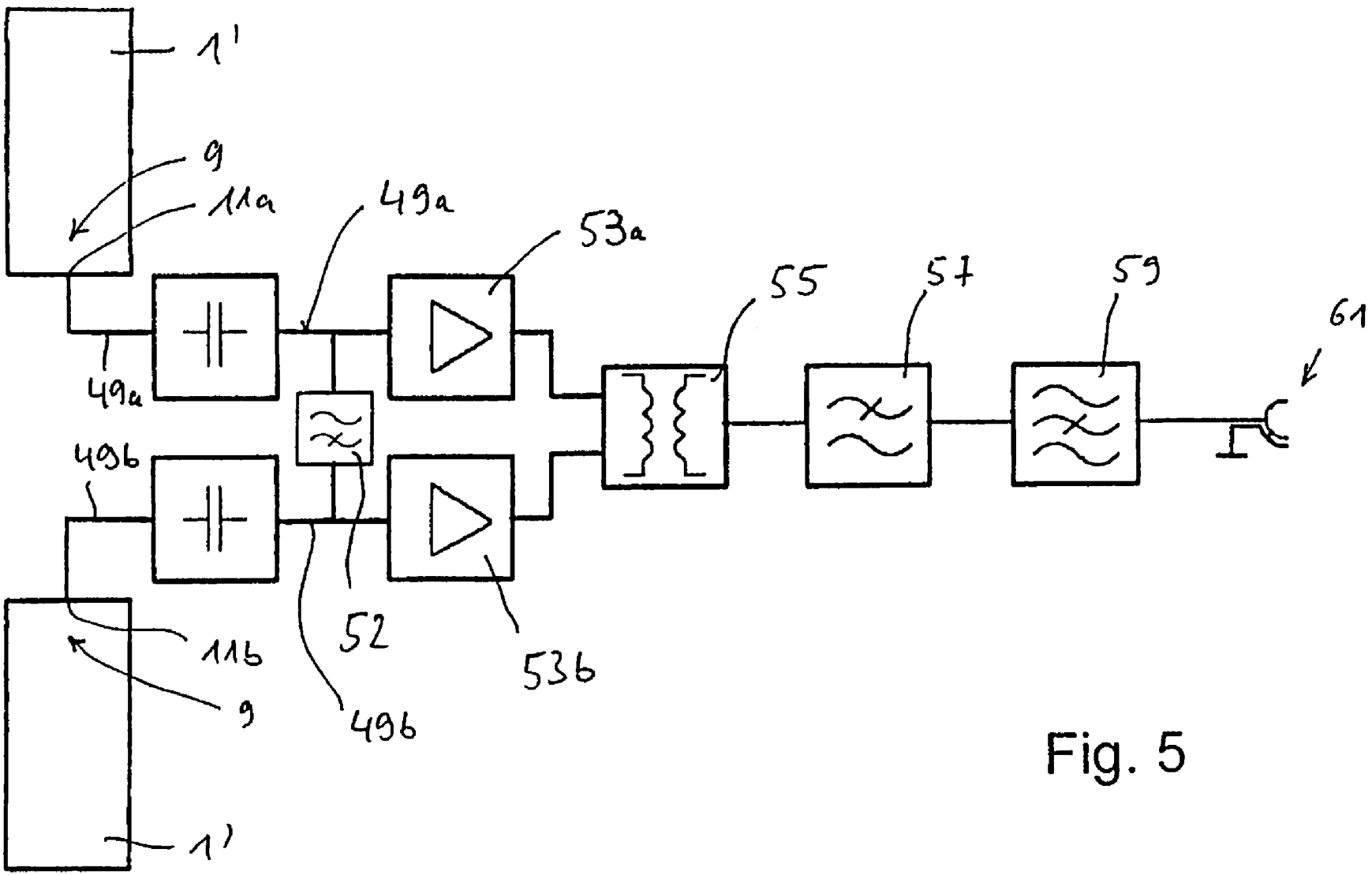

FIG. 4 shows an embodiment of the invention, slightly modified from that shown in FIG. 3, with additional capacitances in the two connecting lines which originate from the dipole halves; and FIG. 5 shows an embodiment which has once again been slightly modified from that shown in FIG. 4, in which the high-pass filter is connected between the two connecting lines, but downstream from the capacitances rather than upstream of them.

Figure 1:
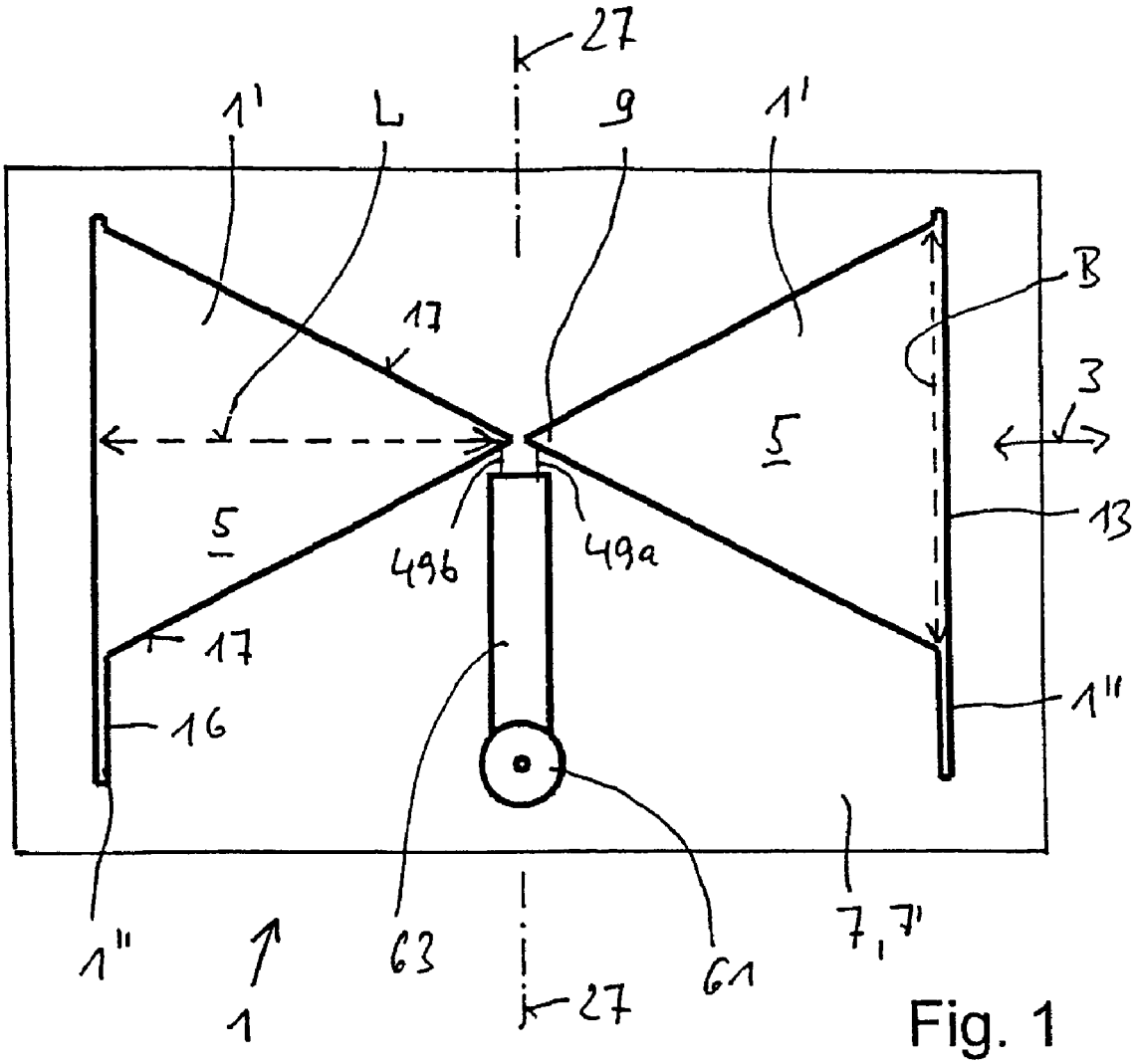
FIG. 1 shows a schematic plan view of the antenna according to the invention.

FIG. 1 shows a schematic plan view of a first exemplary embodiment of an antenna arrangement according to the invention in the form of a flat dipole 1 with two dipole halves 1' which extend in the longitudinal direction 3.

The flat dipole 1 has conductive flat elements 5 for the dipole halves 1', which can preferably be formed on a substrate 7, in particular in the form of a printed circuit board 7'.

Figure 2:
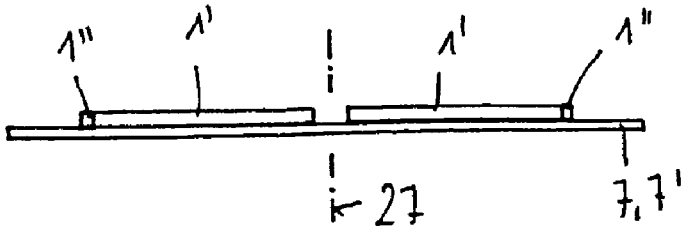
FIG. 2 shows a front view of the antenna parallel to the plane of the substrate, but omitting the coaxial cable connection and the electrical line and components which are electrically connected to the connecting points (which point towards one another) of the dipole halves.

On the basis of the exemplary embodiment shown in FIGS. 1 and 2, the actual dipole halves 1' are designed to be triangular and are aligned such that their tips point towards one another. The dipole halves 1' in this case have a length L and a width B on their base on the plane E on which the dipole halves 1' extend.

The two feed points 11*a* and 11*b* for feeding the respective dipole half 1' are provided at the two inner ends 9 (which point towards one another) of the dipole halves 1' (FIG. 3).

In the illustrated exemplary embodiment, so-called roof capacitances 1" are formed at the opposite, that is to say outer, ends 13 of the dipole halves 1' in order to widen the bandwidth and/or to improve the Q factor of the antenna, which roof capacitances, in the illustrated exemplary embodiment, intrinsically have a rectangular structure and in the process run at right angles to the longitudinal extent 3 of the flat dipole 1. The projections 16 of the roof capacitances 1", that is to say the extent to which the roof capacitances 1" overhang the side boundary edges 17 of the dipole halves 1', may be chosen differently, for optimization. In the illustrated exemplary embodiment, these overhangs 16 are on the one hand each provided on only one side (specifically on the same side as the dipole halves 1') and on the other hand are smaller than the longitudinal size of the dipole halves 1' without the roof capacitances 1". On the other hand, the overhangs have an extent in the transverse direction with respect to the longitudinal direction of the flat dipole 1 which is greater than 10%, and is preferably greater than 20%, being about 20% to 60% in the illustrated exemplary embodiment, and in particular corresponding to about 40% of the longitudinal extent of one dipole half 1'. The width of the roof capacitances 1" in the illustrated exemplary embodiment is kept comparatively narrow and is preferably less than 20%, in particular less than 10% or even less than 5% of the length L of one dipole half.

The exemplary embodiment illustrated in FIGS. 1 and 2 also shows that the dipole halves 1" are preferably arranged symmetrically with respect to a transverse plane of symmetry 27.

In the exemplary embodiment illustrated in FIG. 1, these dipole halves 1' are designed such that they become continuously broader from the inside towards their outer end, so that their side boundary edges 17 run in a divergent form from the inside to the outside. The angle at which the side boundary edges 17 diverge with respect to each dipole half 1' may, for example, be around 30°. Preferred values are 10° to 50°, and in particular 20° to 40°. This therefore results in the dipole halves 1' having a triangular or trapezoidal structure when seen from above. The roof capacitances 1" are likewise once again preferably provided at the outer end and then possibly project only to a minor extent beyond the outer broad end of the dipole halves 1' at the sides. However, in contrast to the exemplary embodiment shown in FIG. 1, other dipole half shapes are also possible. For example, there is no need for the inner tips 9, which point towards one another, so that the shape would be more trapezoidal, with approximately straight boundary edges being formed instead of this on one another on the inside. Furthermore, the boundary edges 17 of the dipole halves also do not need to run in a straight line. In fact, if required, they can also change two or more times from a highly divergent angle to a less divergent angle.

Finally, it is even feasible for the dipole halves 1' to be provided with a rectangular structure so that two rectangular flat elements 5, which are arranged alongside one another in the longitudinal direction 3, are used as dipole halves. This illustrates the fact that, in principle, widely differing shapes are possible for the dipole halves 1', with the chosen triangular to trapezoidal shape being used by preference.

FIG. 3 likewise shows that two amplifier stages, and a coplanar connecting line, which leads to a coaxial cable connection, are provided following the plane of symmetry 27 approximately symmetrically in a longitudinally extending area, as will be described in the following text with reference to FIG. 3.

The two dipole halves 1' are illustrated partially, in a schematic form, once again in FIG. 3 and are triangular in the exemplary embodiment shown in FIG. 1, with their tips being aligned such that they run towards one another symmetrically with respect to the vertical plane of symmetry 27.

The feed point 11*a* and 11*b*, respectively, is then located precisely at the extreme front point 9, of each of the two dipole halves 1', that is to say at the points which are in each case closest to one another, which feed points 11*a* and 11*b* are connected to one another via connecting lines 49*a* and 49*b* as well as a connection line 51, to be precise with a high-pass filter 52 connected between them. This high-pass filter is used to protect the amplifier inputs in particular against powerful VHF transmitters (87 MHz to 108 MHz) and against other radio services in particular below 160 MHz.

The signal which is received via the two dipole halves 1' is supplied via the connecting line 49*a* or 49*b*, respectively, to a respective separate amplifier stage 53*a* or 53*b* (which stages are associated with the individual dipole halves 1') via the connecting lines 49*a* and 49*b*. In order to ensure an embodiment of the antenna arrangement with as low noise as possible, the end areas 9 (which point towards one another) of the dipole halves 1' are each electrically connected as directly as possible to a respective amplifier 53*a*, 53*b*. This connection can be made via connecting lines 49*a* and 49*b* which are as short as possible. The length of these connecting lines should preferably be in the range from 0.2 cm to 3 cm, in particular between 0.5 cm and 1.5 cm. Alternatively, it is also possible to provide a link between the end areas 9 of the dipole halves 1' and the inputs of the amplifiers 53*a* and 53*b* via a capacitance. This capacitance can be based on the use of a discrete component. However, alternatively, it is also possible for the capacitance to be in printed form on the substrate (printed circuit board).

The outputs of the two amplifier stages 53*a*, 53*b* are then supplied to the two inputs of a transformer 55, which is preferably a 1:1 transformer (for example a so-called Guanella transformer).

The output of the transformer 55 is then connected in series to a low-pass filter 57 (a so-called GSM filter for suppression of frequencies which are used in the cellular telephone radio band) and a downstream bandstop filter, that is to say a bandstop filter 59, which is then electrically connected to a coaxial connection 61. The low-pass filter 57 is used in particular to suppress mobile radio frequency bands, in particular the GSM frequencies. In contrast, the object of the bandstop filter 59 is to suppress the range between the two bands, that is to say in the illustrated exemplary embodiment preferably the range between 230 MHz and 470 MHz. It should be noted, just for the sake of completeness, that, in principle, the low-pass filter 57 and the bandstop filter 59 can also be connected in the opposite sequence between the transformer 55 and the coaxial connecting point 61, in contrast to the illustration shown in FIG. 3.

The transmission path from the dipole halves 1' to the transformer 55 is thus approximately balanced. The impedance is a function of the frequency. The impedance on the transmission path from the output of the transformer to the coaxial feed point 61 is preferably 75 ohms, with the coplanar transmission path being unbalanced.

The entire arrangement is accommodated in a rectangular area 63, which extends approximately along the plane of symmetry, on the mount, the substrate or the board 63. The two dipole halves 1' can be formed together with the line sections of the amplifier and transmission stage in the area 63 on the same side with respect to the substrate, the printed circuit board, etc. The amplifier stage with its line sections may, however, also be formed on the opposite side of the substrate, that is to say opposite the correspondingly conductive flat sections of the dipole halves.

The substrate 7 itself may be composed of various materials, for example plastic material, comparable conventional printed circuit boards, or else from materials such as cardboard, paper etc. which are even simpler and cost even less than these.

The antenna, which is intended for DVB-T reception, may, for example, be used for VHF and UHF reception. In this case, it is extremely compact and has a length transversely with respect to the plane of symmetry 27 of, for example, less than 30 cm, and possibly of even less than 20 cm, for example of 15 cm. The transverse extent parallel to the plane of symmetry 27 may be even less.

If the antenna as illustrated in FIG. 1 is installed with its edge located at the bottom in FIG. 1 on a horizontal surface, then it is suitable for reception of horizontally polarized signals. If, in contrast, it is installed rotated through 90° with respect to FIG. 1, that is to say parallel to its outer base edge of the dipole profile halves, then it is suitable for reception of vertically polarized signals.

The following text refers to FIG. 4.

FIG. 4 shows an exemplary embodiment which has been modified only slightly from that shown in FIGS. 1 to 3. In the exemplary embodiment shown in FIG. 4, the two dipole halves 1' do not run towards one another at a point but, in principle, are shown as being rectangular. In general, the dipole halves may have any suitable shape, for example a plan view with an n-sided polygonal shape.

In the same way as in the exemplary embodiment shown in FIGS. 1 to 3, the exemplary embodiment shown in FIG. 4 has connecting lines 49*a* and 49*b* which start from the connecting points 11*a* and 11*b* and lead to the inputs of the respective amplifiers 53*a* and 53*b* in the respective connecting line 49*a* or 49*b*. In this exemplary embodiment as well, the two amplifiers 53*a* and 53*b* are once again connected to the two inputs of a transformer 55, whose common output is connected via a low-pass filter 57, for example a GSM filter and a downstream bandstop filter 59, to a connecting point 61, preferably a coaxial connecting point 61.

In this exemplary embodiment, the two dipole halves 1' are likewise once again connected to one another via a high-pass filter 52.

Now, as an addition to the previous exemplary embodiment, the exemplary embodiment shown in FIG. 4 also has a capacitive coupling 71*a* or 71*b*, respectively, in each connecting line 49*a* or 49*b*, that is to say in general has a respective capacitance 71*a* or 71*b* connected in between (for example in each case in the form of a capacitor).

The high-pass filter 52 shown in FIG. 4 is connected upstream of the capacitances 71*a* and 71*b*, between the two connecting lines 49*a* and 49*b*.

This additionally mentioned capacitance 71*a* or 71*b* is also provided in the exemplary embodiment shown in FIG. 5. In this exemplary embodiment, the high-pass filter 52 is likewise once again connected between the two connecting lines 49*a* and 49*b*. The only difference from FIG. 4 is that the high-pass filter 52 in this exemplary embodiment as shown in FIG. 5 is in each case connected in that path section of the connecting lines 49*a* and 49*b*, respectively, which is located between the output of the respectively associated capacitance 71*a* and the input of the downstream amplifier 49*a* or, respectively, the output of the capacitance 71*b* and the input of the downstream amplifier 53*b*. This is just intended to indicate that the high-pass filter 52 can be connected at different points between the two connecting lines 49*a* and 49*b*.

It can thus be seen from the exemplary embodiments shown in FIGS. 4 and 5 that an improvement is achieved by the connecting lines 49*a*, 49*b* each having at least one capacitance and/or the end areas 9 of the dipole halves 1' being connected to the respective downstream amplifier 53*a*, 53*b* via a capacitive coupling (capacitance).

The invention claimed is:

1. An antenna arrangement having a flat dipole which is arranged on a substrate, comprising:

dipole halves including end areas, the end areas which point towards one another each being electrically connected to respective connecting line, plural amplifiers, the connecting lines leading to said plural amplifiers, a transformer;

the plural amplifiers having outputs, the outputs of the plural amplifiers being connected to the two inputs of the transformer, the output of the transformer being at least indirectly electrically connected to a coaxial connection point, plural filters, the dipole halves being arranged on the substrate together with the plural amplifiers and the plural filters, the plural filters being arranged between the connecting lines which lead to the dipole halves, and the connection point, the filters being provided for suppression of mobile radio frequency ranges and/or as protection for broadcast radio signals, a low-pass filter connected between the outputs of the plural amplifiers and the connection point in order to suppress mobile radio frequencies (cellular telephone frequencies), and a bandstop filter connected between the outputs of the plural amplifiers and the connection point.

2. The antenna arrangement as claimed in claim 1, wherein the bandstop filter is connected downstream from the low-pass filter.

3. The antenna arrangement as claimed in claim 1, wherein the connecting lines are connected to one another via a connection line, with a high-pass filter connected between them.

4. The antenna arrangement as claimed in claim 1, wherein the connecting lines respectively have at least one capacitance, and/or the end areas of the dipole halves are preferably connected to the respective downstream amplifier via a capacitive coupling.

5. The antenna arrangement as claimed in claim 1, wherein the low-pass filter and/or the bandstop filter are/is provided downstream from the transformer and upstream of the connecting point.

* * * * *